United States Patent [19]

Nakayama et al.

[11] 4,210,842

[45] Jul. 1, 1980

[54] COLOR PICTURE TUBE WITH SHADOW MASK

[75] Inventors: Takeshi Nakayama, Tokyo; Takehiko Nishimoto, Kodaira; Machio Kawashima, Mobara; Kozi Takahashi, Mobara; Kuniharu Osakabe, Mobara, all of Japan

[73] Assignee: Hitachi, Ltd., Japan

[21] Appl. No.: 719,154

[22] Filed: Aug. 31, 1976

[30] Foreign Application Priority Data

Sep. 10, 1975 [JP] Japan ..... 50-108989
Apr. 14, 1976 [JP] Japan ..... 51-41295

[51] Int. Cl.[2] ..... H01J 29/07
[52] U.S. Cl. ..... 313/403
[58] Field of Search ..... 313/403–408

[56] References Cited

U.S. PATENT DOCUMENTS 3,766,419 10/1973 Barbin ..... 313/403
3,973,159 8/1976 Barten ..... 313/403

FOREIGN PATENT DOCUMENTS 2012046 10/1970 Fed. Rep. of Germany ..... 313/403

*Primary Examiner*—Robert Segal
*Attorney, Agent, or Firm*—Craig and Antonelli

[57] ABSTRACT

A color picture tube having a shadow mask provided with a plurality of vertical aperture rows arranged as horizontally juxtaposed to one another, each vertical row comprising the electron beam transmissive apertures vertically arranged in line with a predetermined pitch $P_y$. With a view to making possibly occurring moirés imperceptible, the arrangement of the apertures are made such that, when spatial deviation in the vertical positions between any two apertures in the horizontally adjacent aperture rows is represented by $\Delta y$, there may be included combinations of at least two different type aperture rows of different deviations $\Delta y$ which satisfy the following condition $$\frac{(k-0.35)}{2n} Py \leqq \Delta y \leqq \frac{k+0.35}{2n} Py$$

at least when n is equal to 1, 2, 3 or 4 and k is an odd number smaller than 2n.

5 Claims, 41 Drawing Figures n=3 n=4 n=5

Figure 1:
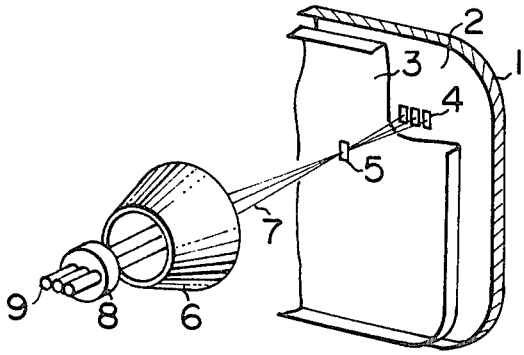

RELATIVE AMPLITUDE OF COMBINED MOIRÉ WAVE
(n = 1)

RELATIVE AMPLITUDE OF COMBINED MOIRÉ WAVE
(n = 2)

RELATIVE AMPLITUDE OF COMBINED MOIRÉ WAVE
(n = 1)

RELATIVE AMPLITUDE OF COMBINED MOIRÉ WAVE
(n = 2)

COLOR PICTURE TUBE WITH SHADOW MASK

The present invention relates in general to a color picture tube with a shadow mask, and in particular to a color picture tube having a shadow mask which is provided with a plurality of electron beam transmissive aperture rows extending perpendicularly to the scanning lines and each comprising a plurality of the individual rectangular apertures for transmission of the electron beams arrayed in line with a predetermined pitch.

Lately, with an effort to simplify the structure of deflection system and at the same time to enhance the visual sharpness of the produced image of the color picture tube with the shadow mask such as color cathode ray tube, Braun tube or the like (hereinafter referred to also as CPT), there have been developed and increasingly employed CPT's of the shadow mask type in which the shadow mask is provided with aperture rows extending orthogonally to the scanning lines and each comprising a plurality of the electron beam transmissive rectangular apertures (hereinafter also referred to as apertures) arrayed vertically in line with a predetermined vertical pitch and in which three electron guns are arrayed in line, in place of the heretofore known color picture with shadow mask in which circular phosphor dots are arrayed in a form of equilateral triangle. However, the color picture tube of the above type suffers from the drawbacks that a strip or fringe pattern, that is, moiré of a great pitch is produced as a result of the interaction between shades of the bridge portions between the rectangular apertures formed vertically in a repeated pattern with the predetermined pitch and the bright-dark portions of the scanning lines, thereby to deteriorate the picture quality of the produced image.

Many and various attempts have been hitherto proposed for reducing the moiré phenomenon. According to a known method, the apertures of the horizontally adjacent aperture rows are deviated from one another in respect of the vertical position for a distance of $1/\alpha \cdot P_y$ where $\alpha$ is an integer and $P_y$ is the vertical pitch of the aperture row. This method starts from two observations. Namely, on one hand, the moiré is determined by the scanning lines and the deviation, since the moiré pitch becomes greater as the difference between the pitch of the scanning line and the vertical pitch of the apertures in the rows is selected smaller and since the deviation causes horizontal fringe whose pitch is $P_y/\alpha$. In other words, the deviation in the vertical position between the horizontally adjacent rows will bring about a shade patern in the substantially horizontal direction and the moiré will become more imperceptible as the magnitude of the deviation is selected smaller because the ratio between the pitch of the scanning line and the pitch of the shade pattern will then become large. On the other hand, in accordance with the other observation, the horizontal pattern of shade, i.e. interlaced dark and bright portions will not be produced if the integrated value of the electron transmissivity or through rate of the apertures remains the same for each of the sanning lines. Accordingly, the moiré can be suppressed by adjusting the deviation and the width of the bridge portions between the vertically aligned aperture in a row. However, the inventors have found after repeated experiments that the hitherto proposed method as described above can not make the moiré in oblique directions imperceptible although the method is certainly effective in suppressing the moiré appearing in a form of bright and dark pattern in the vertical position.

It has also been proposed to array the apertures in a random pattern. However, this solution meets with difficulties in the manufacturing thereof.

Accordingly, a main object of the invention is to provide a color picture tube of the shadow mask type in which the moiré is made imperceptible.

Another object of the invention is to realize a shadow mask for a color picture tube which is effective in suppressing the occurrence of the moiré.

Still another object of the invention is to reduce undesirable influences of moiré due to the harmonics of the luminance distribution pattern of the scanning lines and of the transmissivity or through rate pattern of the vertically arrayed apertures and the poor linearity of the vertical distribution pattern of the scanning lines.

A further object of the invention is to provide a color picture tube which can be employed commonly in NTSC (National Television System Commitee), PAL (Phase Alternation By Line) and SECAM (Séquential à Mèmoire) color television systems without any appreciable moiré.

With the above objects in view, the present invention contemplates to determine the array of the apertures so that the pitch and phase of beat components, ie moirés, produced by the mutual product of the vertical transmissivity or through rate distribution pattern of the aperture row and the vertical luminance distribution pattern of the scanning lines will take predetermined values.

More specifically, the shadow mask according to the present invention is so constructed as to comprise at least two different types of the aperture rows of different deviations which fulfill the following condition:

$$\frac{k-0.35}{2n} P_y \leqq \Delta y \leqq \frac{k+0.35}{2n} P_y \qquad (1)$$

wherein $P_y$ represents the pitch of apertures in the vertical aperture row, $\Delta y$ represents the vertical deviation between the apertures in the horizontally adjacent aperture rows, n is a positive interger of 1 to 5 and k is an odd number smaller than 2n.

The shadow mask according to the invention provides significant advantages particularly when the luminance distribution pattern of the scanning line cannot be approximated by a sine wave or when the face plate of the color picture tube is remarkably curved at peripheral portions.

Above and other objects, features and the advantages of the present invention will become more apparent from the description taken in conjunction with the accompanying drawings which illustrate the principle of the invention as well as preferred embodiments thereof.

Figure 2:
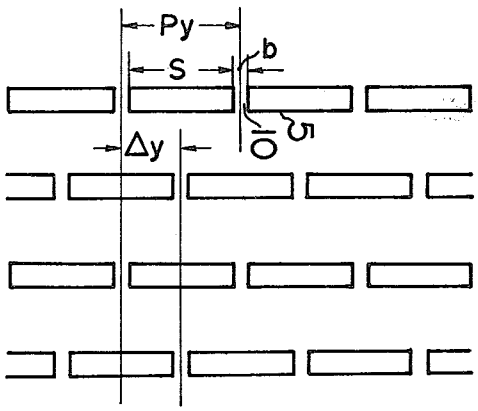
Figure 3:
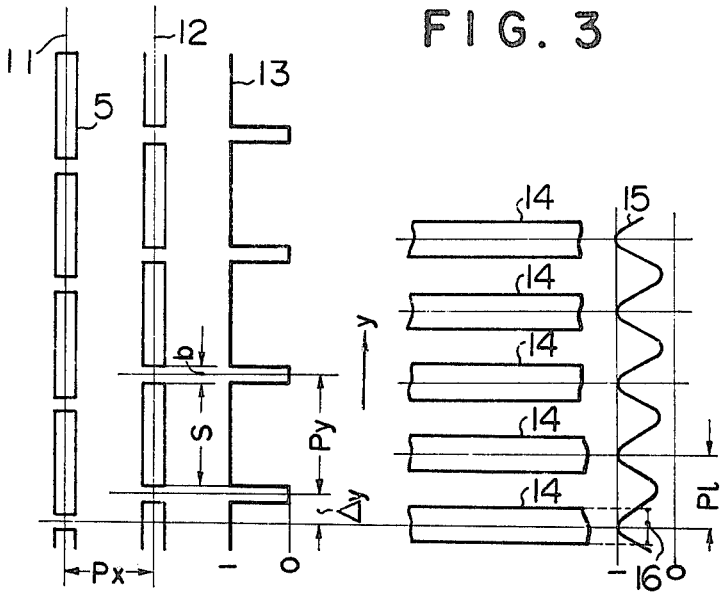
Figure 4:
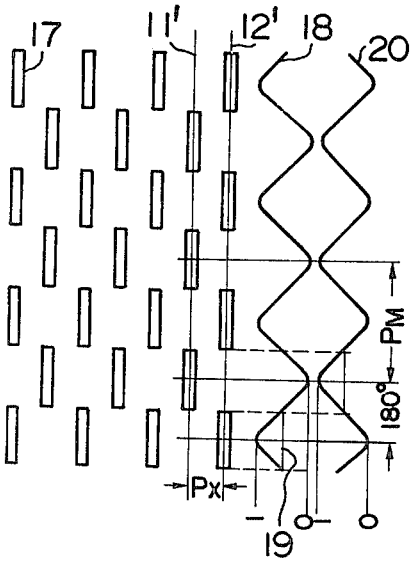
Figure 5:
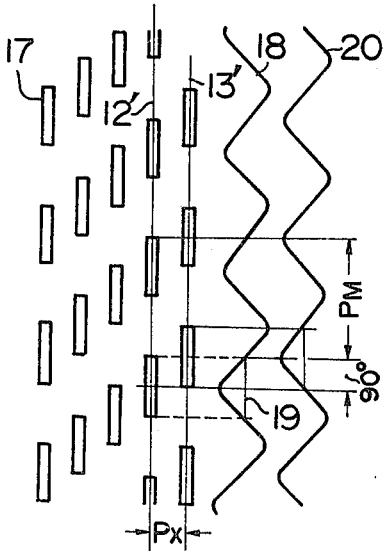
Figure 6:
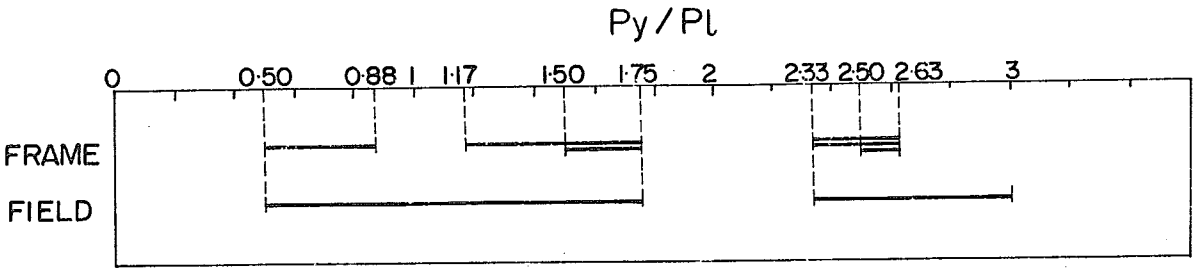
Figure 7:
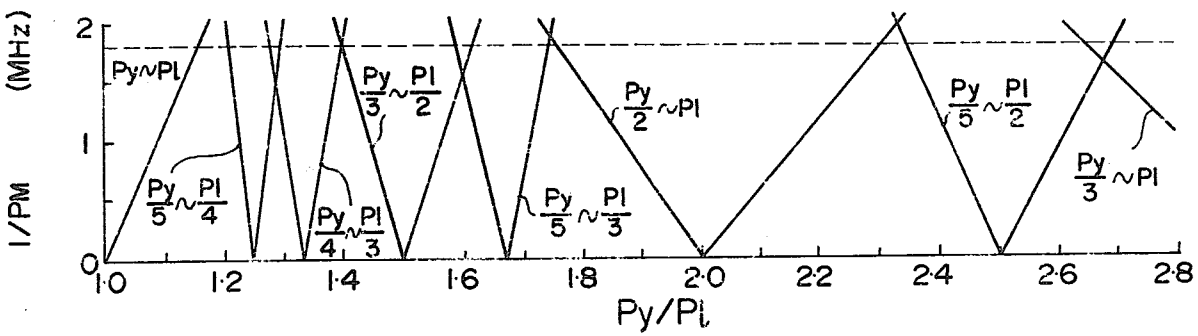
Figure 8:
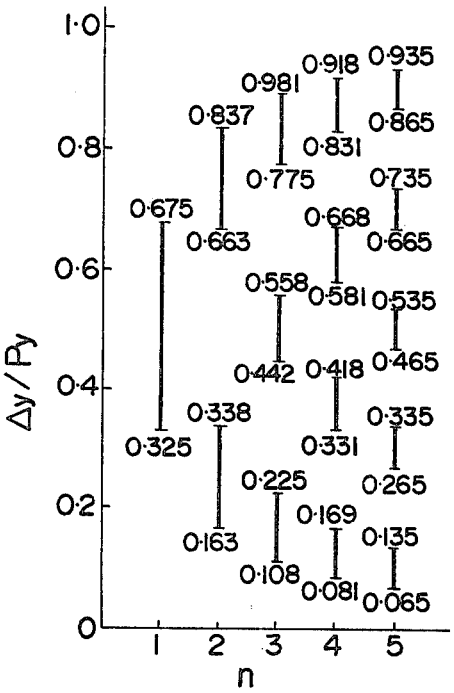
Figure 9:
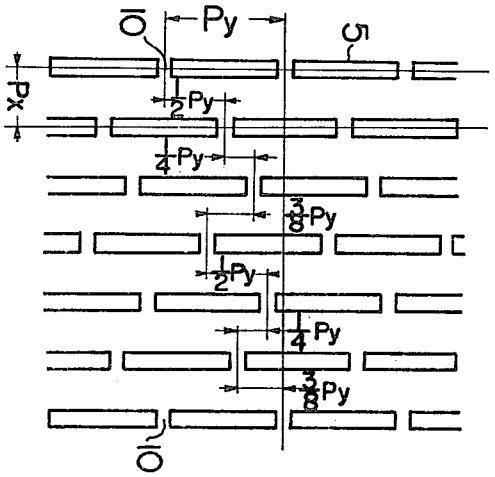
Figure 11:
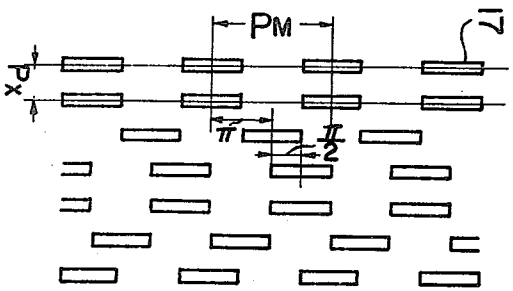
Figure 12:
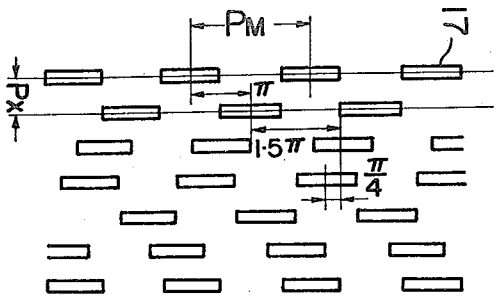
Figure 13:
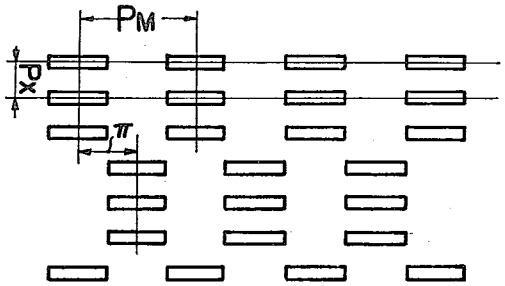
Figure 14:
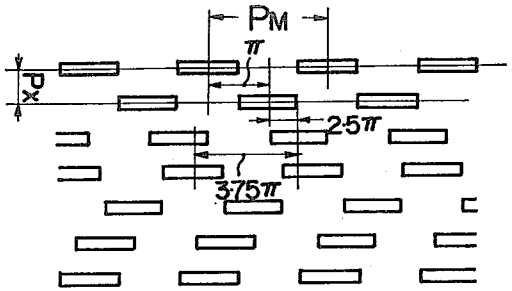
Figure 15:
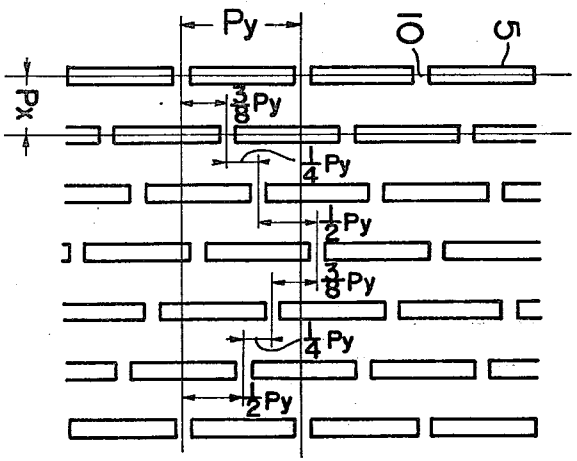
Figure 16:
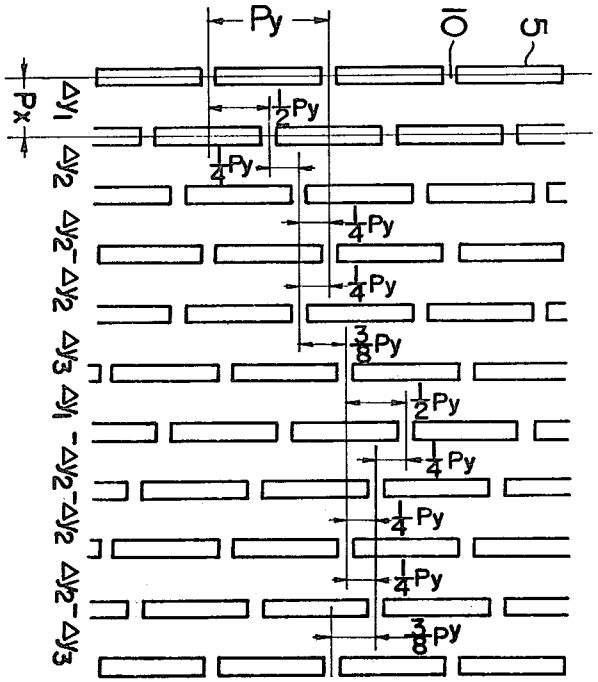
Figure 17:
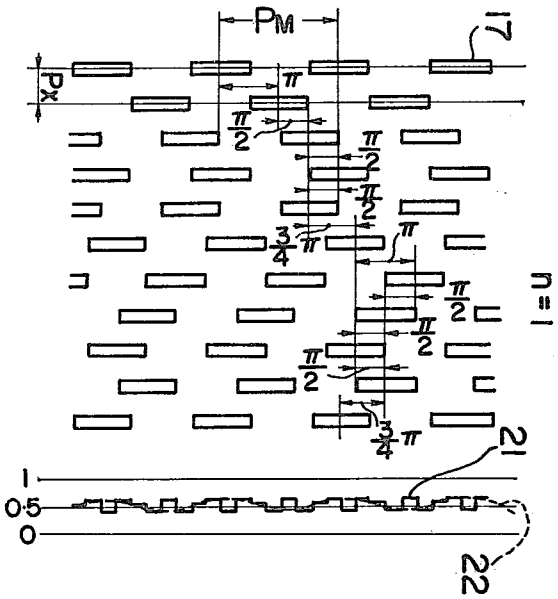
Figure 18:
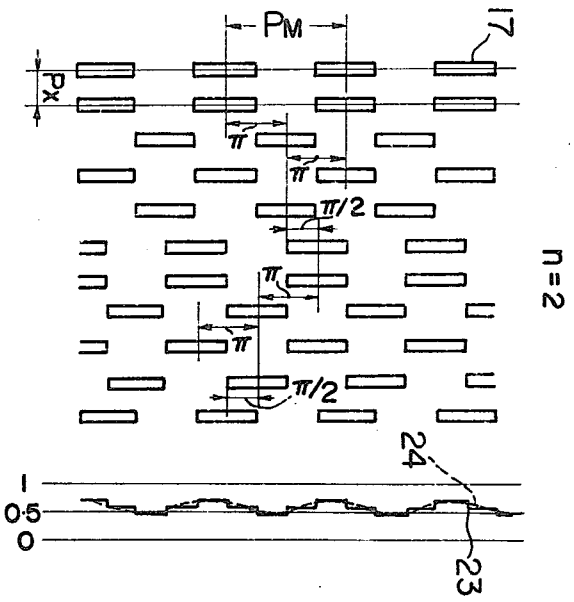
Figure 19:
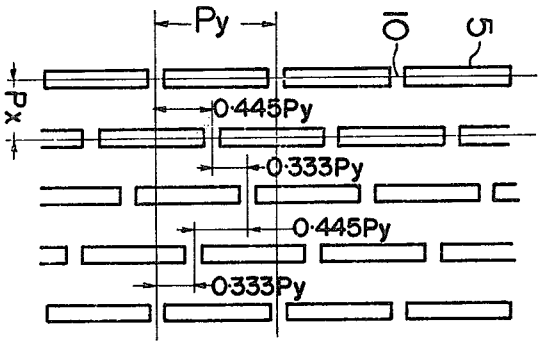
Figure 21:
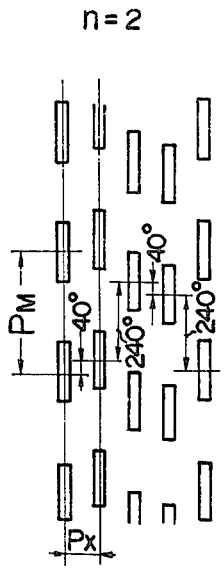
Figure 22:
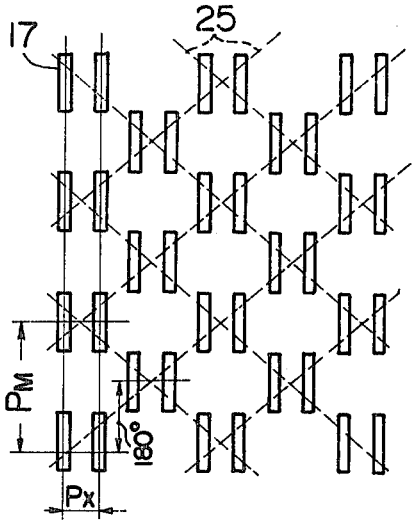
Figure 23:
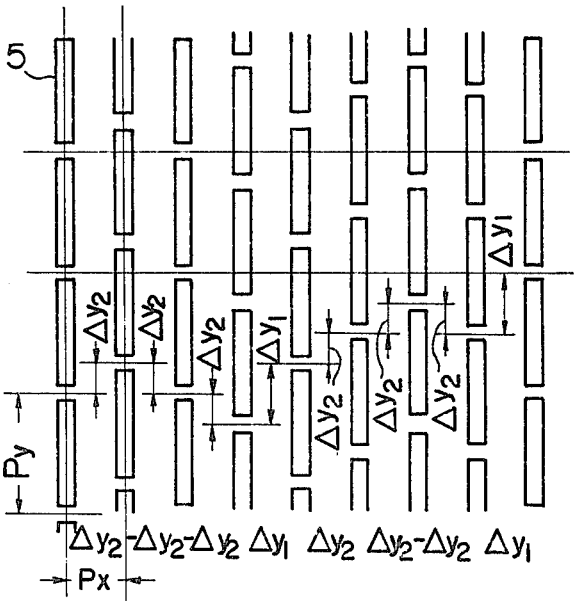
Figure 24:
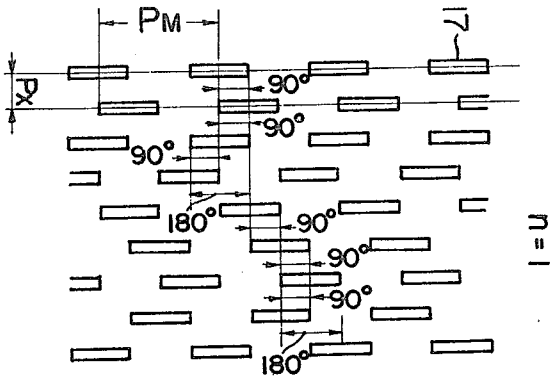
Figure 25:
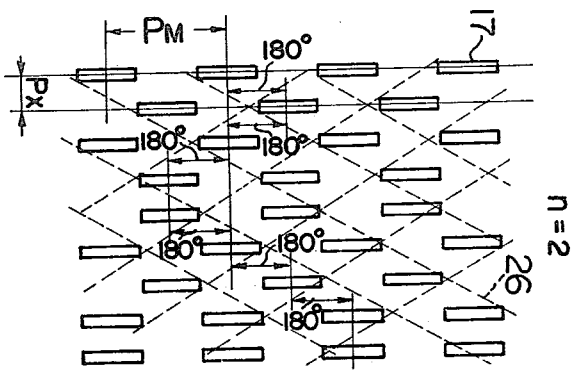
Figure 26:
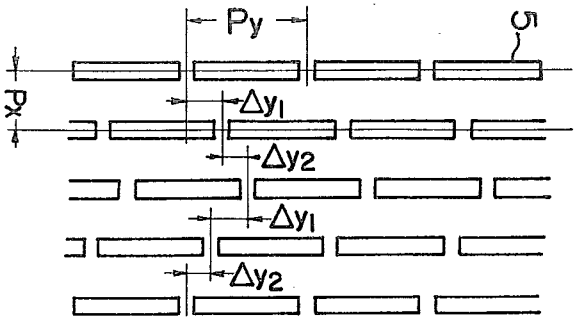
Figure 27:
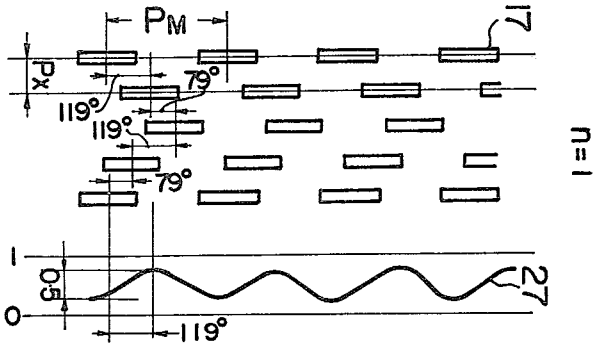
Figure 28:
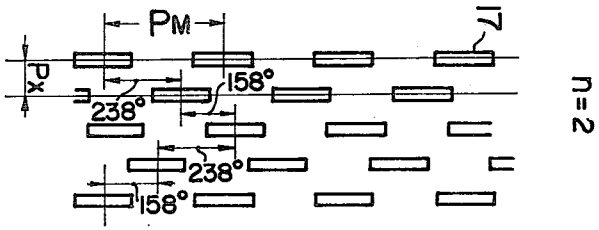
Figure 29:
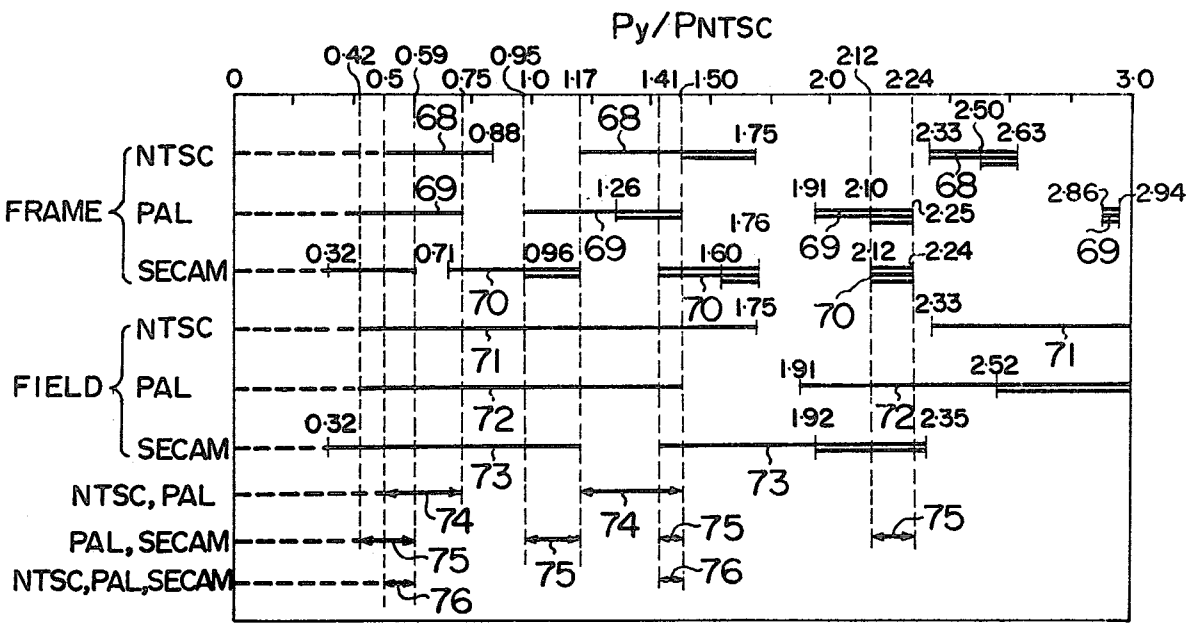
Figure 30:
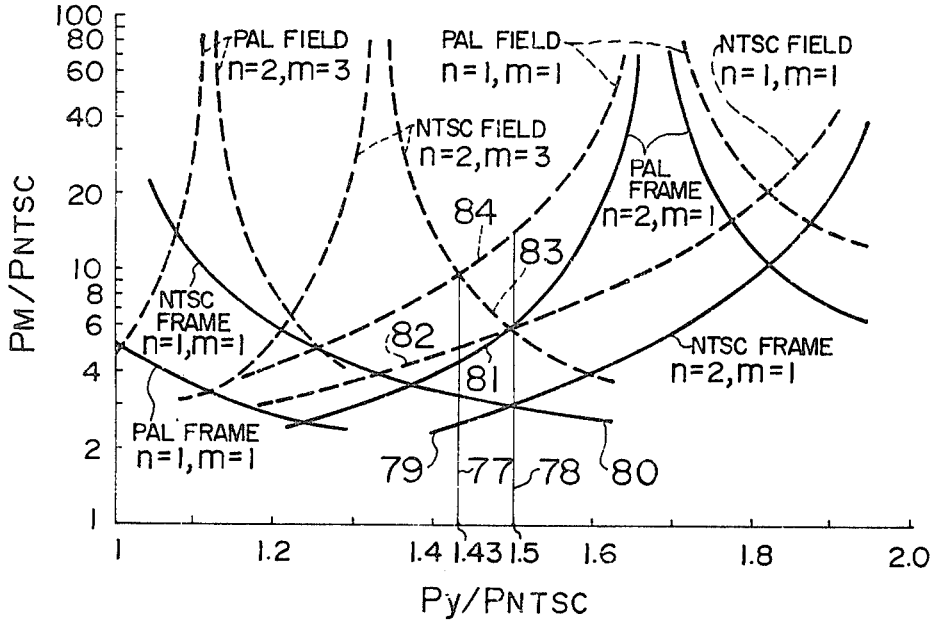
Figure 31:
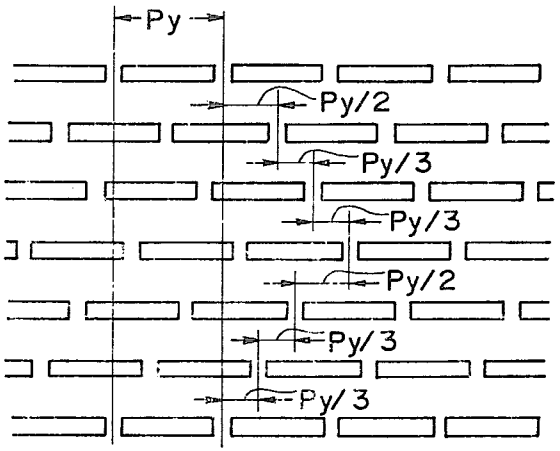
Figure 32:
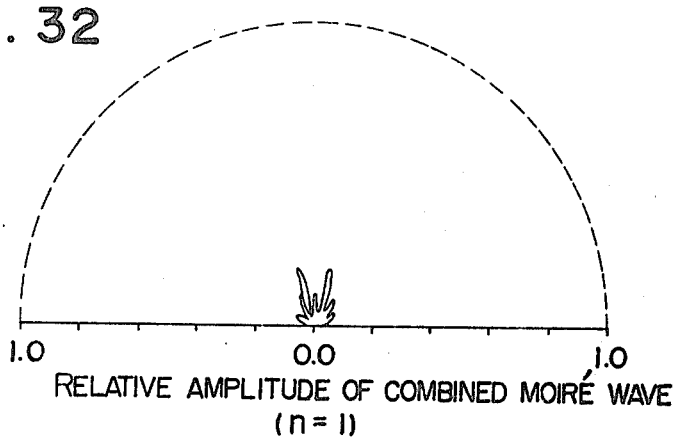
Figure 33:
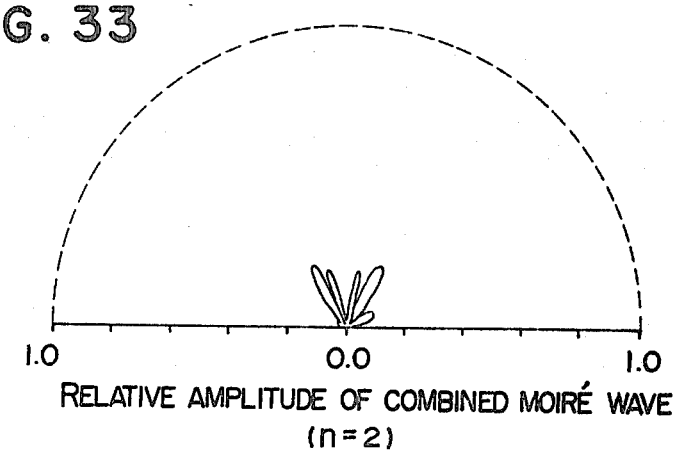

FIG. 1 is a schematic perspective view showing a main portion of a color picture tube to which the present invention can be applied, FIG. 2 is an enlarged fragmental view of a shadow mask, FIG. 3 illustrates relations among the apertures, the scanning lines, the transmissivity or through rate pattern (wave form) of the apertures and the luminance distribution pattern (wave form) of the scanning lines, FIGS. 4 and 5 show patterns of moirés, FIG. 6 illustrates a permissible range of the moiré due to the fundamental component of the luminance distribution pattern or wave form of the scanning lines, FIG. 7 illustrates graphically relations of the pitch of aperture and the pitch of the moirés produced by harmonics of the luminance distribution pattern (wave form) of the scanning lines and the harmonics of the transmissivity distribution or change pattern of the apertures, FIG. 8 illustrates ranges of the ratio between the deviation Δy and the pitch $P_y$ in which the moiré due to the n-th harmonic can be suppressed, FIGS. 9, 15, 16, 19, 23, 26, 31 and 34 are enlarged fragmental views showing arrays of apertures in shadow masks according to embodiments of the invention, FIGS. 10, 11, 12, 13 and 14 illustrate moiré patterns in the shadow mask shown in FIG. 9, FIGS. 17 and 18 illustrate moiré patterns in the shadow mask shown in FIG. 16, FIGS. 20, 21 and 22 illustrate moiré patterns in the shadow mask shown in FIG. 19, FIGS. 24 and 25 illustrate moiré patterns in the shadow mask shown in FIG. 23, FIGS. 27 and 28 illustrate moiré patterns in the shadow mask shown in FIG. 26, FIG. 29 illustrates relations between the various scanning systems of color television and the pitch of the apertures, FIG. 30 illustrates the relation between the pitch of aperture and that of moiré, FIG. 32 and 33 illustrae intensity distributions of the moiré in selected directions in the shadow mask shown in FIG. 31.

Figure 34:
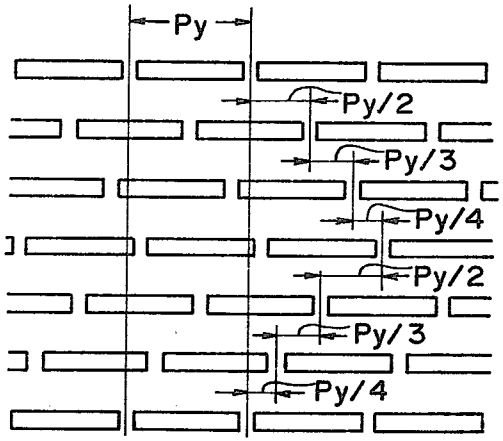
Figure 39:
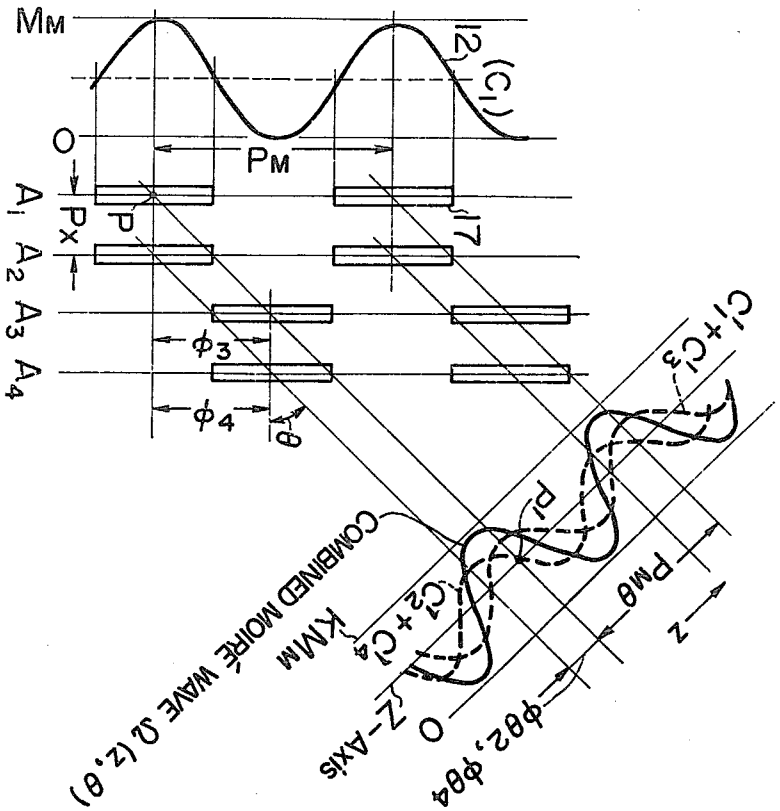
Figure 40:
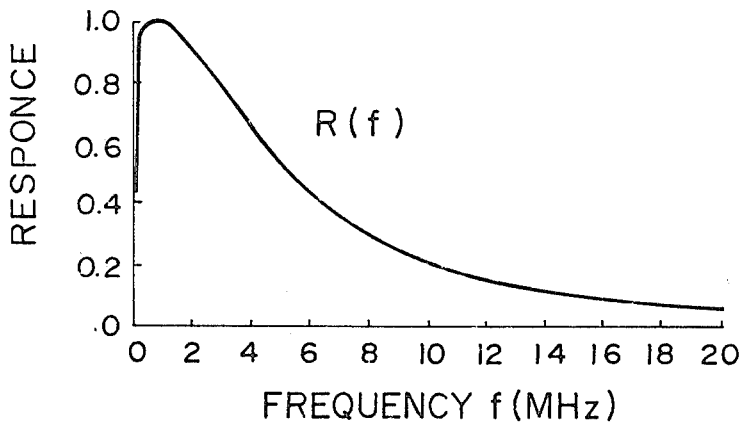
Figure 41:
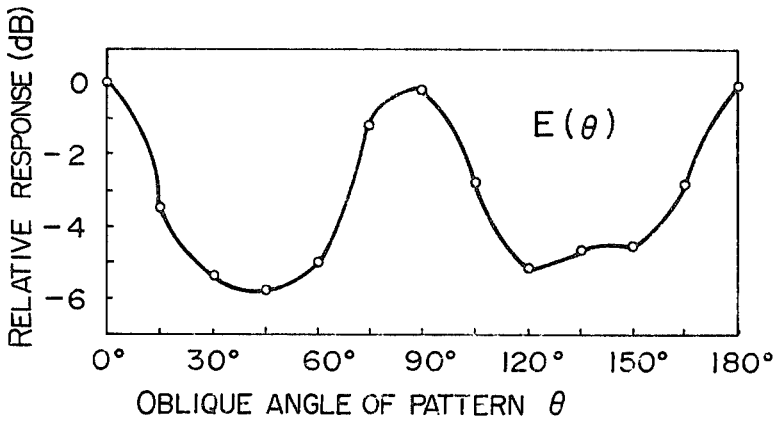

FIGS. 35, 36, 37 and 38 illustrate the intensity distribution of moirés in selected directions in the shadow mask shown in FIG. 34, FIGS. 39 illustrates a combined moiré pattern (waveform) resulting from individual moirés, FIG. 40 illustrates spatial frequency characteristics of visual system, and FIG. 41 illustrates anisotropy of response of the visual system.

For the convenience' sake of description, it is assumed that the invention is applied to a color picture tube shown in FIG. 1. In the figure, the electron beams 7 emitted from an electron beam emitting system 9 composed of three electron guns 8 disposed in a linear array are deflected by a deflection magnetic field produced by the deflection system 6, and are then directed to phosphor dots 4 of primary colors, i.e. red, green and blue applied on the inner surface 2 (hereinafter referred to as screen) of a panel 1 through rectangular apertures provided in a shadow mask 3. The shape of the phosphor dots 4 corresponds to the shape of the apertures. The relative positions of the individual phosphor dots 4 of three primary colors irradiated by three electron beams 7 passing through one aperture 5 are determined on the basis of the geometrical configuration of the three electron guns 6.

FIG. 2 shows a shadow mask in an enlarged fragmental view. It can be seen that vertically elongated apertures 5 for transmission of the electron beams are arrayed in the vertical direction with a predetermined pitch $P_y$. The vertically adjacent apertures 5 are separated by a bridge portion 10 of width b from each other. Aperture rows each comprising a plurality of the aperture arrayed in this manner are juxtaposed to one another in the horizontal direction with vertical deviation Δy existing between the apertures in any horizontally adjacent aperture rows.

The occurence of moiré can be explained as follows: The screen 2 is scanned by the electron beams horizontally, as a result of which horizontal fringes or strips of bright and dark portions are produced on the screen 2 along the scanning lines. On the other hand, shadows of the bridge portions 10 provided for each pitch $P_y$ are produced on the screen 2. Thus, the bright and dark pattern, that is, moiré is produced on the screen due to the beat between the dark portions of the scanning lines and the shadows of the bridge portions 10. The moiré itself is observed on the screen 2. However, since the occurrence of moiré is ascribable to the fact that portions of the scanning lines are periodically interupted in the vertical direction due to the corresponding interruption of the electron beams 7 through the apertured shadow mask 5, it had better to regard that the scanning lines lie over the shadow mask, for the convenience' sake of discussion. In this connection, it is however to be noted that the pitch of the scanning lines on the shadow mask should be considered to be contracted for about 5%, since the vertical pitch $P_y$ of the apertures 5 of the shadow mask 3 is enlarged for about 5% when projected on the screen 2. In any cases, since the ratio between the pitch of the scanning lines and that of the apertures remains unchanged, the description may be made on the assumption that the scanning lines are present on the shadow mask.

FIG. 3 shows relations between the apertures 5 of the shadow mask and the scanning lines 14 thereon as well as the vertical relation between the patterns or waveforms of the aperture transmissivity and the scanning line distribution, respectively. In the figure, reference numerals 11 and 12 denote horizontally adjacent aperture rows, while reference numeral 13 indicates the transmissivity distribution pattern or waveform $G_s(y)$ of the aperture rows produced when the aperture row 12 is uniformly illuminated by the electron beams over the whole surface. Numeral 15 indicates the luminance pattern or waveform $G_l(y)$ of the scanning lines in the vertical direction. Accordingly, the combined pattern or waveform G(y) resulting from the mutual product of the waveforms $G_s(y)$ and $G_l(y)$ can be expressed as follows:

$$G(y)l = G_s(y) \cdot G_l(y) \tag{2}$$

wherein $$G_l(y) = Bo + \sum_{n=1}^{\infty} Bn \cos n\omega_s(y - \Delta y) \tag{3}$$

and wherein $$\omega_s = 2\pi\mu_p \quad \text{and} \quad \mu_p = \frac{1}{P_y} \tag{4}$$

Bo: d.c. component of the aperture transmissivity pattern or waveform, and

Bn: amplitude of the n-th harmonic.

The waveform $G_l(y)$ may be in general given in a similar form to the equation (3).

$$G_l(y) = Ao + \sum_{m=1}^{\infty} Am \cos m\omega y \tag{5}$$

wherein

Ao: d.c. component as expressed in Fourier series, and

Am: amplitude of the m-th harmonic.

In the equation (5), $\omega_l$ represents angular frequency given by the following equation (7).

$$\omega_l = 2\pi\mu_l \tag{7}$$

wherein $$\mu_l = 1/P_l \tag{8}$$

The waveform G(y) represents the product of the equations (3) and (6). Since the equation (3) is an orthogonal function, each term thereof can be treated separately. Accordingly, $G_{mn}(y)$ which is the product of the n-th harmonic of $G_s(y)$ and the m-th harmonic of $G_l(y)$ may be expressed as follows:

$$\begin{aligned} G_{mn}(y) &= [Bo + Bn\cos n\,\omega_s(y-\Delta y)]\cdot(Ao + Am\cos m\omega y) \\ &= AoBo + \underline{\frac{BnAm}{2}\cos\left[2\pi\left(\frac{n}{P_y} - \frac{m}{P_l}\right)y - \frac{2n\pi\Delta y}{P_y}\right]} \\ &+ AoBn\cos\frac{2n\pi}{P_y}(y-\Delta y) + BoAm\cos\frac{2m\pi}{P_l}y \\ &+ \frac{BnAm}{2}\cos\left[2\pi\left(\frac{n}{P_y} + \frac{m}{P_l}\right)y - \frac{2n\pi\Delta y}{P_y}\right] \end{aligned} \tag{9}$$

The underlined term represents the moiré component. Thus, the pitch $P_M$ of the moiré, the phase difference $\phi_M$ thereof when deviation $\Delta y$ exists between the aperture rows and the luminance modulation rate $M_M$ of the moiré may be given by the following expressions (10), (11) and (12), respectively.

$$P_M = \left|\frac{P_y P_l}{nP_l - mP_y}\right| \tag{10}$$

$$\phi_M = \frac{2n\pi\Delta y}{P_y} \tag{11}$$

$$M_M = \frac{BnAm}{2AoBo} \tag{12}$$

The luminance modulation rate or factor $M_M$ is determined by the width b of the bridge portion 10 shown in FIG. 2 and the spot brigthness distribution, and can not be arbitrarily varied, although the moiré becomes more imperceptible as the quantity $M_M$ decreases. More specifically, $M_M$ can be decreased when the diameter of the bright spot is selected at a greater value. Further, $M_M$ can be made smaller by selecting b smaller. However, there are practically imposed restriction on the attempt to enlarge the bright spot as well as to reduce the width b of the bridge portion in view of the current tendency to select the diameter of the spots as small as possible in order to attain a sharp focus as well as the mechanical view point to impart a sufficient strength to the shadow mask. Arbitrarily controllable quantities are therefore $P_M$ of the equation (10) and $\phi_M$ of the equation (11).

In the first place, the relation between the phase difference $\phi_M$ and the moiré will be examined. FIGS. 4 and 5 show two examples of the spatial patterns of moiré. Reference numeral 17 denotes the bright portions of the moiré. In practice, three phosphor dots of the primary colors, i.e. red, green and blue are horizontally aligned and give forth light on the screen. However, in order for the correspondence between the apertures of the shadow mask and the phosphor dots to be clearly indicted, only the light emission pattern of the green phosphor dot which has the highest brightness among the dots is shown in the figures. It is also assumed that the bright portion 17 corresponds to the half-amplitude level of the vertical luminance distribution pattern or waveform 18 of the moiré. If the pitch of the waveforms 18 and 20 on the phosphor dot rows 11' and 12' are represented by $P_M$ with the assumption that the phase difference between the waveforms 18 and 20 is 180°, then, the two-dimensional pattern of the moiré will be such as shown in FIG. 4, in which the fringes of dark and bright portions are hardly perceptible and the presence of the oblique patterns are also scarcely appreciable due to the fact that the angles at which both the rightwardly and the leftwardly rising patterns are inclined are equal to each other. When the phase difference $\phi_M$ is remarkably aberrated from 180° to 90° for example, the oblique pattern will become perceptible, as shown in FIG. 5. It will thus be understood that the moiré can be made imperceptible when the phase difference $\phi_M$ is set at 180° or k·180° wherein k is an odd number. In order to confine the phase difference $\phi_M = 2n\pi\Delta y/P_y$ in a predetermined range of $\pm\Delta\theta$ with reference to $k\cdot\pi$ wherein $\pi$ is 180°, the following conditions have to be satisfied.

$$k\pi - \Delta\theta \leqq \frac{2n\pi\Delta y}{P_y} \leqq k\pi + \Delta\theta \tag{13A}$$

and hence $$\frac{k - \frac{\Delta\theta}{\pi}}{2n}P_y \leqq \Delta y \leqq \frac{k + \frac{\Delta\theta}{\pi}}{2n}P_y$$

Admitting that the difference in response of the visual system lies with in 3dB, then $\Delta\theta$ will be 63° which corresponds to a change of 35% in $\Delta y$. Hence, the range of the deviation $\Delta y$ is given by $$\frac{k - 0.35}{2n}P_y \leqq \Delta y \leqq \frac{k + 0.35}{2n}P_y \tag{13B}$$

Further, this range can also be represented in term of phase difference.

$$117° \leqq \phi_M \leqq 243° \tag{13C}$$

Next, discussion will be made on the pitch $P_M$ of the moiré. For the sake of simplicity of description, it is assumed that m is equal to 1 in the equation (10). The upper limit of the moiré pitch $P_M$ is to be limited by the period (pitch) of the upper limit frequency of video signal reproduced in images on the screen and should not exceed the latter. Since the subcarrier of the chrominance signal has a frequency of 3.58 MHz in the case of the NTSC television system, the luminance signal will lie in the band range lower than 3.58 MHz. The upper limit may thus be set at 3.6 MHz. The pitch of the image reproduced by the signal of this frequency corresponds to 3.5 in terms of the pitch of the scanning lines. Because the phase difference between moirés produced by the horizontally adjacent aperture rows is selected at 180° in accordance with the invention, the pitch of the horizontal fringes of the moiré will be in effectiveness a half of $P_M$. Accordingly, the permissible upper limit of the moiré pitch is given by $$P_M/P_l \leqq 7.0 \tag{14}$$

Relations between $P_y$ and n as determined from the formulae (10) and (14) in view of the foregoing discussion with m being equal to 1 are illustrated in FIG. 6 at the location identified by "FRAME". In the figure, a single line segment indicates the region in which n=1, while duplicate and triplicate line segments represent the regions in which n=2 and n=3, respectively. All the illustrated regions of $P_y/P_l$ in respect of the frame are the ranges in which the pitch $P_M$ of the moiré will remain at small values. When $P_y/P_l$ becomes greater than 3, there is no regions in which the condition expressed by the formula (14) is fulfilled.

In the case of the prevailing television system in which the interlaced scanning is carried out at the ratio of 2:1, not only the moiré due to the pitch $P_l$ of the scanning line per frame and the pitch $P_y$ of the mask aperture, but also the moiré caused by the scanning line per field the number of which is a half of that of the frame will become perceptible on the screen because of the dynamic characteristic of eye. Such moiré will become more remarkable when the eye or the obseved image is moved. This phenomenon may be explained by the fact that the relative velocity of the scanning lines and the tracing eye is low.

As can be seen from FIG. 6, in the range where $$P_y/P_l \leqq 3.0 \tag{15}$$

n is equal to 1 in respect of the field. Accordingly, in order to make the moiré imperceptible in respect of both the field and the frame, the phase difference $\phi_M$ of the moiré has to be so selected that no definite moiré patterns may be perceived at n(=1) and (=2) or n(=1) and n(=3) in dependence upon the value of the ratio $P_y/P_l$.

The above analysis has been made for the simplicity's sake of description on the moiré caused by the fundamental waveform of the luminance pattern 15 of the scanning lines, the fundamental waveform of the vertical aperture transmissivity pattern 13 and the harmonics thereof. However, in practice, the moiré due to the harmonics of the luminance pattern or waveform 15 of the scanning lines and the harmonics of the vertical aperture transmissivity pattern or waveform 13 will also provide a problem. The regions of $P_y$ in which the moiré pitch $P_M$ due to the beat between the harmonics is remarkable is shown in FIG. 7, in which the moiré frequency $1/P_M$ is taken along the ordinate in terms of the corresponding video signal frequency on the scanning line. As can be seen by comparing FIGS. 6 and 7 with each other, there may arise the case in which imperceptibility of the moiré pattern does not occur, even when $P_y$ and $\Delta y$ are so selected for a single value of n that the phase difference $\phi_M$ of moiré becomes out of phase for 180° or k·180°. In a practical CPT, the pitch $P_l$ of the scanning lines is not uniform, but appears more dense at the peripheral portion of the image screen for the observer since the panel 1 is curved as shown in FIG. 1, even when the pitch $P_l$ of the scanning lines is displayed uniformly on the screen 2. Besides, when the linearity of the vertical scanning waveform is poor, the pitch $P_l$ of the scanning lines will be adversely influenced. For the practical purpose, it is therefore required that $P_y$ and $\Delta y$ should be determined in consideration of the values of $P_M$ and $\phi_M$ when $P_y$ varied 10 to 20% from the value determined on the basis of the conditions shown in FIGS. 6 and 7. In other words, determination of the values of $P_y$ and $\Delta y$ corresponding to the single value of n is insufficient to make the moiré pattern acceptably imperceptible in the practical sense. Next, examination will be made on the range on the values of n which are allowable from the practical viewpoint.

The perceptibility of the moiré pattern will depend on the moiré pitch $P_M$ and the luminance modulation rate or factor $M_M$ of the moiré if the viewing distance is constant. When $S/P_y$ is selected at 0.9 which will approximately meet the practiced condition in the case where the row of the vertically elongated apertures has the transmissivity or through-rate pattern 13, the quantity $B_n$ in the quation (3) will take the following values:

$B_1=0.219$
$B_2=0.208$
$B_3=0.191$
$B_4=0.168$
$B_5=0.142$

As will be appreciated from the above, in the case of n=5 the amplitude of the harmonic component will be decreased to about 60% of the amplitude at n(=1). The amplitude decreased at n(=6) will become lower than 50% as compared with the case in which n=1. Accordingly, if the limit is to be set at 50%, the last harmonic to be considered is the fifth harmonic:

Accordingly, the invention is also intended to determine a plurality of $\Delta y$ which fulfill the equation (13) in order to make the moiré insignificant for the harmonics of the order n greater than 3, inclusive, and provide a shadow mask having aperture arrays comprising in combination, aperture rows having different $\Delta y$ as determined.

In more detail, reference is made to FIG. 8 which shows graphically the relation between $\Delta y$ and n of the equation (13).

Values of $\Delta y$ corresponding to the mid values of the regions shown in FIG. 8 is given by $$\Delta y = kP_y/2n \tag{16}$$

wherein $k \leqq 2n$. Assuming that n is 1, 2, 3, 4 or 5, the deviations $\Delta y_n$ which meet the equation (16) are determined from the following formulae.

$$\left.\begin{aligned}
\Delta y_1 &= \frac{P_y}{2}\ (n=1)\\
\Delta y_2 &= \frac{P_y}{4} \text{ or } \frac{3P_y}{4}\ (n=2)\\
\Delta y_3 &= \frac{P_y}{6},\ \frac{P_y}{2} \text{ or } \frac{5P_y}{6}\ (n=3)\\
\Delta y_4 &= \frac{P_y}{8},\ \frac{3P_y}{8},\ \frac{5P_y}{8} \text{ or } \frac{7P_y}{8}\ (n=4)\\
\Delta y_5 &= \frac{P_y}{10},\ \frac{3P_y}{10},\ \frac{P_y}{2},\ \frac{7P_y}{10} \text{ or } \frac{9P_y}{10}\ (n=5)
\end{aligned}\right\} \tag{17}$$

By selecting appropriate $\Delta y$ from the above, it is possible to decrease the moiré over the range of n=1 to 3, n=1 to 4 or n=1 to 5.

In the following, a concrete example of the arrangement including three kinds of combinations of the aperture rows having different $\Delta y$ for the harmonics of n=1 to 5 will be described.

From the equation (17)

$$\Delta y_1 = P_y/2 \tag{18}$$

At such $\Delta y$, it is possible to make the phase difference $\phi_M$ equal to the (180°) for every one of n=1, 3 and 5. Next, $\Delta y_2$ and $\Delta y_3$ for the cases in which n=2 and n=4, respectively, are determined by $$\Delta y_2 = \frac{k_2 P_y}{4} \ (1 < k_2 \text{ (an odd number)} < 4) \quad (19)$$

$$\Delta y_3 = \frac{k_3 P_y}{8} \ (1 < k_3 \text{ (an odd number)} < 8) \quad (20)$$

and arrayed sequentially together with the aforementioned $\Delta y_1$. Then, $\phi_M(=\pi)$ will be valid for all the harmonics of n(=1, 2, 3, 4 and 5). The values of $P_y$ required in this determination may be selected from the ranges shown in FIG. 6.

As will be understood from the above, the moiré pitch $P_M$ should in principle be small for all the harmonics of the orders n(=1 to 5) when the moirés due to these harmonics are to be disposed of. However, in practice, it is especially desirable to determine the value of $P_y$ so that the moiré pitch $P_M$ is decreased primarily at n(=1 or 2) at which the luminance modulation rate or factor of the moire pattern is great. When $P_y$ is the range where n=1 is selected from the FIG. 6 and the different deviations $\Delta y$ of the pitch between the apertures of the adjacent rows are combined in three different combinations, the moirés due to a given m-th harmonic of the luminance pattern of the scanning lines and the first to fifth harmonics of the aperture transmissivity pattern are individually phase-shifted for 180° at least once for every third row in the horizontal direction. When $P_y$ is selected in the range wherein n=2 from the FIG. 6, the moiré produced in the field at n(=1) can be overcome by selecting the above determined value for $\Delta y$. Additionally the moirés due to from the second to the fifth harmonics of the aperture transmissivity pattern and the harmonics of the luminance pattern of the scanning lines can also be significantly suppressed.

Moreover, it has been advantageously found that the moiré component in a particular direction can be made much more imperceptible by arraying $\Delta y_1$, $\Delta y_2$ and $\Delta y_3$ in an appropriate sequence in a repeated manner. For example, the integrated pattern of the moirés in the horizontal direction can be made negligible.

In this connection, when the phase difference $\phi_M$ is to be made equal to $\pi(180°)$ for n(=1 to 5) with three different values of $\Delta y$, the equations (18) to (20) can be satisfactorily employed. However, when the value of $\phi_M$ is to be permitted to the range shown in equation (13C), the ranges of $\Delta y_1$ to $\Delta y_3$ can be selected as follows:

$$\left.\begin{array}{ll} & 0.465\,P_y \leqq \Delta y_1 \leqq 0.535\,P_y \\ & 0.163\,P_y \leqq \Delta y_2 \leqq 0.338\,P_y \\ \text{or} & 0.663\,P_y \leqq \Delta y_2 \leqq 0.837\,P_y \\ & 0.081\,P_y \leqq \Delta y_3 \leqq 0.169\,P_y \\ \text{or} & 0.331\,P_y \leqq \Delta y_3 \leqq 0.418\,P_y \\ \text{or} & 0.581\,P_y \leqq \Delta y_3 \leqq 0.668\,P_y \\ \text{or} & 0.831\,P_y \leqq \Delta y_3 \leqq 0.918\,P_y \end{array}\right\} \quad (21)$$

Next, a process for arraying these $\Delta y_i$ will be described. By way of example, it is assumed that values of $\Delta y$ for n=1, 3 and 5, for n=2 and n=4 are given by $$\Delta y_1 = P_y/2 \quad (22)$$

$$\Delta y_2 = P_y/4 \quad (23)$$

$$\Delta y_3 = 3P_y/8 \quad (24)$$

FIG. 9 shows a first embodiment of the shadow mask in which the deviations $\Delta y_1$, $\Delta y_2$, $-\Delta y_3$, $\Delta y_1$, $-\Delta y_2$ and $\Delta y_3$ are horizontally arrayed in this order. The sign (+) means the deviation $|\Delta y|$ in the upward direction, while the sign (−) means the deviation in the downward direction. In the aperture pattern shown in FIG. 9, the bridge portions 10 of every sixth vertical aperture row are aligned with each other in the horizontal direction with the pattern of the apperture array repeated every sixth vertical aperture row in the horizontal direction. The number of horizontal pitches of the aperture row at which the array pattern of the aperture is repeated is dependent on the absolute magnitude of $\Delta y$ and the polarities or signs thereof. For example, it is possible to repeat the array pattern at the pitches in number given by 6+3i, wherein i is an integer, e.g. 6, 9, 12, 15 pitches and so forth.

Figure 10:
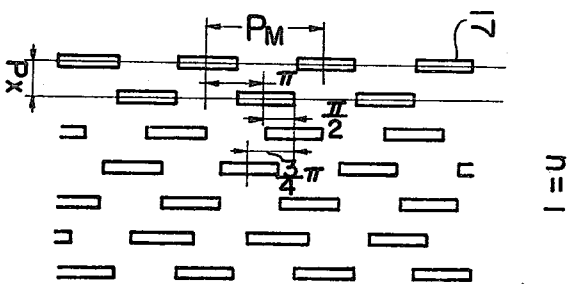

The two-dimensional pattern of the bright portions 17 of the moiré occurring due to the aperture array pattern for n(=1) is shown in FIG. 10. The aperture rows in the shadow mask shown in FIG. 9 corresponds to the rows of moiré bright portions shown in FIGS. 10 to 14. Since the vertical deviation between the apertures of the first and the second rows as counted from the left is $\Delta y_1$ or $P_y/2$, the phase difference $\phi_M$ is $\pi$ from the equation (11) as shown in FIG. 10. The phase difference corresponding to the deviation $\Delta y_2$ or $P_y/4$ between the second and the third rows is $\pi/2$ for n(=1) from the equation (11). In the similar manner, it is possible to determine the phase difference $\phi_M$ for any particular values of n from the equation (11). The moiré patterns determined in this way when n is equal to 2, 3, 4 and 5 are shown in FIGS. 11, 12, 13 and 14, respectively. As can be seen from these figures, no perceptible moiré patterns or fringes are produced in the range of n=1 to 5. Besides, it will be noted that no significant oblique moiré pattern occurs in any particular direction.

FIG. 15 shows a second embodiment of the shadow mask according to the invention. In this embodiment, the vertical deviations between the aperture rows are arrayed in the sequence of $\Delta y_3$, $\Delta y_2$, $\Delta y_1$, $-\Delta y_3$, $-\Delta_2$, and $-\Delta y_1$ in this order. As can be appreciated from the comparison with the embodiment shown in FIG. 9, the luminance modulation or change rate of the moiré forming the horizontal fringe is further decreased. On the other hand, the luminance change rate of the oblique moire patterns rising leftwardly and rightwardly at the same angle is somewhat great as compared with those of the embodiment shown in FIG. 9.

FIG. 16 shows a third embodiment of the invention. In the case of the above described embodiments shown in FIGS. 9 and 15, equal waiting is adopted for n=1, 2, 3, 4 and 5, whereby the same number of $\Delta y_1$, $\Delta y_2$ and $\Delta y_3$ are present in the repeated aperture array pattern. However, when weight is to be imparted to a particular value of n, this can be accomplished by increasing the number of the deviation $\Delta y$ between the adjacent aperture rows corresponding to the particular n. In the case of the embodiment shown in FIG. 16, the value of n(=2) is weighed and hence the appearing frequency of $\Delta y_2$ is selected three times as many as that of $\Delta y_1$ and $\Delta y_3$. The array of the deviations is such as shown in FIG. 16. The two-dimensional patterns of the bright portions 17 when n=1 and 2 are shown in FIGS. 17 and 18, respectively. The waveform 21 shown in FIG. 17 is obtained by integrating in the horizontal direction the vertical patterns of the bright portions 17 of moiré. It can be seen that the waveform 21 will take a rectangular shape having amplitude of ±1 when all the values of $\phi_M$ are zero. On the other hand, the waveform 21 is in a form of a straight line of a level of 0.5 when all the values of $\phi_M$ are $\pi$. The amplitude of the fundamental wave provides a measure for the brightness of the horizontal moiré, as indicated by a dotted line 22 in FIG. 17. Similarly, the waveforms 23 and the dotted line 24 show the horizontal luminance modulation or change of moiré in the case where n=2. As will be appreciated from the comparison between both cases (FIGS. 17 and 18), there can be seen no substantial differences in effectiveness between these moiré waveforms. This means that the shadow mask shown in FIG. 16 can be equally employed for the case where n=1 although the aperture array pattern is designed with weight imposed on the case where n=2. Even for n>2, the eyesore horizontal fringes of moiré will not be produced, the reason for which is omitted for simplicity.

Next, a method for making the moiré imperceptible for the values 1 to 5 of n by employing two different deviations Δy of aperture rows.

In the case of the above described embodiments, three different values of Δy, i.e. $\Delta y_1$, $\Delta y_2$ and $\Delta y_3$ are required in order to make the phase difference $\phi_M$ equal to $\pi$ for the individual values (1 to 5) of n. However, when the phase difference $\phi_M$ in the range defined by the equation (13C) is permissible, two different ranges of Δy will be sufficient. Namely, $$\left.\begin{aligned} 0.442\,P_y \leqq \Delta y_1 \leqq 0.558\,P_y \\ 0.331\,P_y \leqq \Delta y_2 \leqq 0.335\,P_y \end{aligned}\right\} \quad (25)$$

With the above range of $\Delta y_1$, the phase difference $\phi_M$ can be confined in the range defined by the equation (13C) for the cases where n=1 or 3. Further, with the above range of $\Delta y_2$, the phase difference $\phi_M$ can be confined in the range defined by the equation (13C) also for the case where n=2, 4, or 5. If the phase difference of moiré due to the n-th harmonic is represented by $\phi_{Mn}$, the phase differences due to $\Delta y_1$ are given by $$\left.\begin{aligned} 159^\circ \leqq \phi_{M1} \leqq 201^\circ \\ 117^\circ \leqq \phi_{M3} \leqq 243^\circ \end{aligned}\right\} \quad (26)$$

The phase difference due to $\Delta y_2$ are given by $$\left.\begin{aligned} 238^\circ \leqq \phi_{M2} \leqq 241^\circ \\ 117^\circ \leqq \phi_{M4} \leqq 122^\circ \\ 236^\circ \leqq \phi_{M5} \leqq 243^\circ \end{aligned}\right\} \quad (27)$$

Figure 20:
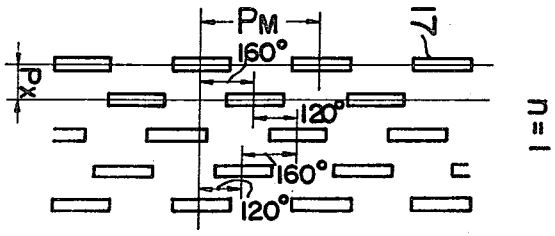

A fourth embodiment of the shadow mask provided with the aperture array with $\Delta y_1=0.445$ and $\Delta y_2=0.333$ as well as moiré patterns thereof for n(=1 and 2) are shown in FIGS. 19, 20 and 21, respectively.

The ranges of $\Delta y_1$ and $\Delta y_2$ which can be employed for different combination of values of n in addition to the ranges defined by the equations (25) are listed in the table 1, in which $a_1$, $b_1$ and $a_2$, $b_2$ are defined by the following formulae.

$$a_1P_y \leqq \Delta y_1 \leqq b_1P_y$$

$$a_2P_y \leqq \Delta y_2 \leqq b_2P_y$$

It should be noted that plural combinations of $a_1$ and $b_1$ or $a_2$ and $b_2$ or of the both can be employed for the same combination of n.

Table 1

| | $\Delta y_1$ | | | $\Delta y_2$ | | |
|---|---|---|---|---|---|---|
| Case | n | $a_1$ | $b_1$ | n | $a_2$ | $b_2$ |
| 1 | 1,2 | 0.325 | 0.338 | 3,4,5 | 0.108 | 0.135 |
| | | 0.663 | 0.675 | | 0.865 | 0.891 |
| 2 | 1,3 | 0.442 | 0.558 | 2,4,5 | 0.331 | 0.335 |
| 3 | 1,5 | 0.465 | 0.553 | 2,3,4 | 0.163 | 0.169 |
| | | | | | 0.831 | 0.837 |
| 4 | 2,3 | 0.163 | 0.225 | 1,4,5 | 0.331 | 0.335 |
| | | 0.775 | 0.837 | | 0.665 | 0.668 |
| 5 | 2,4 | 0.163 | 0.169 | 1,3,5 | 0.465 | 0.535 |
| | | 0.331 | 0.338 | | | |
| | | 0.663 | 0.668 | | | |
| | | 0.831 | 0.837 | | | |
| 6 | 3,4 | 0.108 | 0.169 | 1,2,5 | 0.335 | 0.338 |
| | | 0.831 | 0.891 | | 0.665 | 0.675 |
| 7 | 3,5 | 0.108 | 0.135 | 1,2,4 | 0.331 | 0.338 |
| | | 0.465 | 0.535 | | 0.663 | 0.668 |
| | | 0.865 | 0.891 | | | |

As will be appreciated from the above, it is possible to make the moiré imperceptible for the cases where n=1, 2, 3, 4 and 5 by employing two or three different values of Δy. However, a sufficient practical utility may be attained by making the moire imperceptible for n(=1, 2, 3 and 4). In such case, it is equally possible to employ two or three different values of Δy.

In some case, it will be sufficient to suppress the moiré due to n(=1, 2 and 3). Under such conditions, two different Δy may be employed such as, $$\left.\begin{aligned} \Delta y_1 = \frac{P_y}{2} \\ \Delta y_2 = \frac{P_y}{4} \end{aligned}\right\} \quad (28)$$

With the above value of $\Delta y_1$, it is possible to make the phase difference $\phi_M$ of moiré equal to 180° for the odd-numbered harmonics such as of the order n(=1, 3, 5 . . . ,). With the above $\Delta y_2$, the phase difference $\phi_M$ of 180° ($\pi$) can be attained for the second harmonic, namely for n(=2). Through the combinations of these values of Δy, the generation of the moiré pattern in a form of horizontal fringes or strips can be prevented except for the case of the fourth harmonic (n=4). In this conjunction, when the deviation array is made such that $\Delta y_1$ and $\Delta y_2$ will alternatively appear in the horizontal direction, i.e. in the order of $\Delta y_1$, $\Delta y_2$, $\Delta y_1$, $\Delta y_2$ . . . , the moiré pattern due to the second harmonic (n=2) will be such as shown in FIG. 22 in which a grid-like moiré pattern of a great pitch as well as oblique patterns 25 are remarkable. To evade from such disadvantage, the deviation array pattern including $\Delta y_2$ in number twice or three times as many as that of $\Delta y_1$ may be employed.

Further, by selecting values for $\Delta y_1$ and $\Delta y_2$ which are different from those defined by the equation (28), the oblique moiré pattern can be suppressed significantly with the same frequency or number of $\Delta y_1$ and $\Delta y_2$.

FIG. 23 shows an array of apertures 5 in a shadow mask 3 according to the fifth embodiment of the invention. In the figure, $\Delta y_1$ and $\Delta y_2$ are defined by the formulae (28). In this embodiment, the deviation $\Delta y_2$ is employed with a frequency three times as many as $\Delta y_1$. The moiré patterns produced by such aperture array due to the harmonics of n(=1) and n(=2) are shown in FIGS. 24 and 25, respectively. Referring to FIG. 24 for $n=1$, the phase difference of moiré $\phi_M$ corresponding to $\Delta y$ is given by the formula (11) and hence $\phi_M$ will be 180° with $\Delta y_1$ and 90° with $\Delta y_2$. Since $n=2$ in the case of FIG. 25, the phase difference $\phi_M$ will be 0° with $\Delta y_1$ and 180° with $\Delta y_2$. The perceptibility of the moirés in the horizontal direction and the oblique direction denoted by dotted line 26 may be determined by the amplitudes of the integration waveforms of the projections on the axes orthogonal to the horizontal and the oblique directions.

In the case of the embodiment shown in FIG. 23, the amplitude of the integration waveform is zero for both the horizontal and the oblique moiré patterns which therefore will not make appearance. In the embodiment shown in FIG. 23, the values of $\Delta y_1$ and $\Delta y_2$ are not restricted to those defined by the equation (28). When the phase difference $\phi_M$ of moiré falls within the range given by $$117° \leqq \phi_M \leqq 243° \tag{29}$$

the moiré suppressing effect will undergo no substantial degradation. Accordingly, in order to make the moiré imperceptible for $n=1$, 3 and $n=2$, the values of $\Delta y_1$ and $\Delta y_2$ which falls within the ranges defined by the following expressions can be equally employed.

$$\left.\begin{aligned} 0.442\,P_y &\leqq \Delta y_1 \leqq 0.558\,P_y \\ 0.163\,P_y &\leqq \Delta y_2 \leqq 0.338\,P_y \end{aligned}\right\} \tag{30}$$

In general, it is sufficient that $\Delta y_1$ and $\Delta y_2$ are in the range defined by the equation (13B).

Additionally, when $$\left.\begin{aligned} a\,P_y &\leqq \Delta y_1 \leqq b\,P_y, \text{ and} \\ c\,P_y &\leqq \Delta y_2 \leqq d\,P_y \end{aligned}\right\} \tag{31}$$

wherein a, b, c and d are selected at values listed in Table 2, the phase difference $\phi_M$ for corresponding value of n listed in the Table 2 can be confined in the range defined by the equation (29).

Table 2

| | $\Delta y_1$ | | | $\Delta y_2$ | | |
|---|---|---|---|---|---|---|
| Case | n | a | b | n | c | d |
| 1 | 1 | 0.325 | 0.675 | 2,3 | 0.163 | 0.225 |
| 2 | 3 | 0.108 | 0.225 | 1,2 | 0.325 | 0.337 |
| 3 | 3 | 0.442 | 0.558 | 1,2 | 0.325 | 0.337 |

With respect to the Table 2, the following formulae $$\left.\begin{aligned} (1-a)\,P_y &\geqq \Delta y_1 \geqq (1-b)\,P_y \\ (1-c)\,P_y &\geqq \Delta y_2 \geqq (1-d)\,P_y \end{aligned}\right\} \tag{32}$$

represent the inversion of the patterns defined by the formulae (31) and can be equally employed with the same effectiveness.

Further, following combination of $\Delta y_1$ and $\Delta y_2$ $$\left.\begin{aligned} a\,P_y &\leqq \Delta y_1 \leqq b\,P_y \\ (1-c)\,P_y &\geqq \Delta y_2 \geqq (1-d)\,P_y \end{aligned}\right\} \tag{33}$$

as well as the inverted combination $$\left.\begin{aligned} (1-a)\,P_y &\geqq \Delta y_1 \geqq (1-b)\,P_y \\ c\,P_y &\leqq \Delta y_2 \leqq d\,P_y \end{aligned}\right\} \tag{34}$$

may also be employed. The above patterns allow the suppression of moirés due to the harmonics of the order n(=1, 2 and 3). In the case wherein the amplitude of the second harmonic of the scanning lines is great (see, FIG. 7) and provides a cause of moirés in cooperation with the fifth harmonic of the aperture transmissivity pattern, the moirés due to the n-th harmonics wherein $n=1$, 2, 3 and 5 can be suppressed by employing combinations of the values for $\Delta y_1$ and $\Delta y_2$ listed in the Table 3.

| | $\Delta y_1$ | | | $\Delta y_2$ | | |
|---|---|---|---|---|---|---|
| Case | n | a | b | n | c | d |
| 4 | 1,3 | 0.442 | 0.558 | 2,5 | 0.265 | 0.335 |
| 5 | 3,5 | 0.108 | 0.135 | 1,2 | 0.325 | 0.337 |
| 6 | 3 | 0.108 | 0.225 | 1,2,5 | 0.325 | 0.335 |
| 7 | 1,3 | 0.442 | 0.558 | 1,2,5 | 0.325 | 0.335 |
| 8 | 1,3,5 | 0.465 | 0.535 | 1,2,5 | 0.325 | 0.335 |
| 9 | 1,3,5 | 0.465 | 0.535 | 2 | 0.163 | 0.337 |
| 10 | 1,3,5 | 0.465 | 0.535 | 1,2 | 0.325 | 0.337 |
| 11 | 1,3,5 | 0.465 | 0.535 | 2,3 | 0.163 | 0.225 |

In this case, the equation (13) is also valid for the 1st, 2nd, 3rd and 5th harmonics. The equations (32), (33) and (34) are applicable also to the patterns defined above. Further, the formula (13B) is valid for all the harmonics of $n=1$, 2, 3, 4 and 5 when $\Delta y_1$ and $\Delta y_2$ are combined as listed up in the Table 4.

Table 4

| | $\Delta y_1$ | | | $\Delta y_2$ | | |
|---|---|---|---|---|---|---|
| Case | n | a | b | n | c | d |
| 12 | 3,4,5 | 0.108 | 0.135 | 1,2,4 | 0.331 | 0.338 |
| 13 | 1,3,5 | 0.465 | 0.535 | 2,3,4 | 0.163 | 0.169 |
| 14 | 1,3,5 | 0.465 | 0.535 | 1,2,4 | 0.331 | 0.338 |
| 15 | 3,4 | 0.108 | 0.169 | 1,2,4,5 | 0.331 | 0.335 |

By adopting the combinations of $\Delta y_1$ and $\Delta y_2$ listed in the Table 4, even when the focussing of the electron beams is effected sharply and therefore the moirés due to the third harmonic of the luminance distribution pattern of the scanning lines (see FIG. 7) and the fourth harmonic of the aperture transmissivity pattern becomes into question, the moirés can be suppressed.

In the fifth embodiment described above, the ranges of $\Delta y_1$ and $\Delta y_2$ which are effective to suppress the n-th harmonics wherein $n=1$, 2, 3 or 1, 2, 3, 5 or 1, 2, 3, 4, 5 can be determined on the basis of the formula (13B). In a quite similar manner, the ranges of $\Delta y_1$ and $\Delta y_2$ which is effective for the first, second third and fourth harmonics may be easily determined from FIG. 8.

FIG. 26 shows a sixth embodiment of the invention. In the case of the above described fifth embodiment, the number of $\Delta y_2$ at which the phase difference $\phi_M$ of moiré becomes 180° for the second harmonic, i.e. $n=2$ is increased to dispose of the oblique moiré pattern. The sixth embodiment is also designed so as to suppress the moiré pattern due to the second harmonics. However, the aperture array pattern of this embodiment is different from that of the fifth embodiment in that different values of $\Delta y$ are adopted. Namely, referring to FIG. 26, the aperture array shown therein meets the following conditions.

$$0.325P_y \leqq \Delta y_1 \leqq 0.338P_y \quad (36)$$

$$0.163P_y \leqq \Delta y_2 \leqq 0.225P_y \quad (37)$$

Under these conditions, the phase difference $\phi_M$ of moiré will fall within the range defined by the equation (29) for the n-th harmonics wherein $$\left.\begin{array}{l} n = 1, 2 \text{ with } \Delta y_1 \\ n = 2, 3 \text{ with } \Delta y_2 \end{array}\right\} \quad (38)$$

Additionally, the values of $\Delta y_1$ and $\Delta y_2$ listed in Table 5 provides the similar effect.

Table 5

| | $\Delta y_1$ | | | $\Delta y_2$ | | |
|---|---|---|---|---|---|---|
| Case | n | a | b | n | a | b |
| 1 | 1,2 | 0.325 | 0.338 | 2,3 | 0.163 | 0.225 |
| 2 | 1,2 | 0.325 | 0.338 | 2,3,4 | 0.163 | 0.169 |
| 3 | 1,2,4 | 0.331 | 0.338 | 2,3 | 0.163 | 0.225 |
| 4 | 1,2,5 | 0.325 | 0.335 | 2,3 | 0.163 | 0.225 |
| 5 | 1,2,4,5 | 0.331 | 0.335 | 2,3 | 0.163 | 0.225 |

In these cases, the formulae (32), (33) and (34) are equally applicable.

FIGS. 27 and 28 show fragmentally the moiré patterns produced in the shadow mask having the aperture pattern according to the sixth embodiment. FIG. 27 shows the moiré pattern in the case wherein n=1, while FIG. 28 is for the case wherein n=2.

In the first case (n=1), the moiré of the horizontal fringes can be observed to some degree. However, in the second case wherein n=2, both the phase differences $\phi_M$ due to $\Delta y_1$ and $\Delta y_2$ will approximate to 180° to bring about substantially ideal moiré patterns, as will be clearly understood from the comparison of FIG. 28 with FIG. 3. The luminance change rate of the horizontal fringes for n(=1) is 50% as indicated by the intergration waveform 27 of the horizontal luminance distribution pattern of the moiré and decreases to 50% of the luminance change rate in the precisely inphase case wherein $\phi_M=0$.

Next, applications of the invention to various television systems will be described. Heretofore, different color television systems such as NTSC, PAL or the like in which the number of the scanning lines are different from one another require respective different shadow masks having different vertical pitch $P_y$. In contrast, the present invention makes it possible to use one and the same shadow mask in common for plural different color television systems.

As described hereinbefore, the moiré should be made imperceptible not only for the scanning lines constituting one frame, but also for the scanning lines constituting one field particularly when the imperfect interface is to be taken into consideration. It has been found that the pitch $P_M$ of moiré for a frame should fulfill the condition:

$$P_M \leqq 7P_{NTSC} \quad (39\text{-a})$$

and the moiré pitch $P_M$ for a field should meet the condition:

$$P_M \leqq 14P_{NTSC} \quad (39\text{-b})$$

In FIG. 29, the n-th harmonics of the vertical aperture transmissivity pattern of the aperture rows and the corresponding regions of $P_y$ in the various types of the television systems such as NTSC, PAL and SECAM are shown by traverse line segments in a similar manner as in FIG. 6. More specifically, the region 68 is effective for the frame in NTSC television system, region 71 is effective for the field in NTSC system, regions 69 and 72 are effective for the frame and the field in PAL system, respectively, and the regions 70 and 73 are effective for the frame and the field in SECAM system.

Since, according to the invention, the vertical pitch $P_y$ is determined independently from the values of n, so far as the latter is in the range up to 5, the regions of $P_y$ in which the line segments for the different television systems are concurrently present can be adopted in common for these television systems. In FIG. 29, the regions 74 of the vertical pitch $P_y$ usable in common for NTSC and PAL systems can be expressed as follows:

$$\left.\begin{array}{l} 0.5\ P_{NTSC} \leqq P_y \leqq 0.75\ P_{NYSC} \\ 1.17\ P_{NTSC} \leqq P_y \leqq 1.50\ P_{NTSC} \end{array}\right\} \quad (40)$$

wherein $P_{NTSC}$ represents the pitch of the scanning line in NTSC television system.

On the other hand, the region 75 of $P_y$ which can be adopted in common for both PAL and SECAM system are given by $$\left.\begin{array}{l} 0.42\ P_{NTSC} \leqq P_y \leqq 0.59\ PO_{NTSC} \\ 0.95\ P_{NTSC} \leqq P_y \leqq 1.17\ P_{NTSC} \\ 1.41\ P_{NTSC} \leqq P_y \leqq 1.50\ P_{NTSC} \\ 2.12\ P_{NTSC} \leqq P_y \leqq 2.24\ P_{NTSC} \end{array}\right\} \quad (41)$$

Finally, the regions 76 of $P_y$ usable in common for all NTSC, PAL and SECAM systems are expressed by $$\left.\begin{array}{l} 0.5\ P_{NTSC} \leqq P_y \leqq 0.59\ P_{NTSC} \\ 1.41\ P_{NTSC} \leqq P_y \leqq 1.50\ P_{NTSC} \end{array}\right\} \quad (42)$$

Corresponding values of $\Delta y$ may be determined in a similar manner as described hereinbefore in conjunction with the first to sixth embodiments.

By way of an example, a shadow mask designed to be used commonly in NTSC and PAL television systems will next be described in detail.

FIG. 30 shows relationships of the moiré pitch $P_M$ to the scanning lines of frame and field in NTSC and PAL system as a function of the variable $P_y$. In the figure, relations between the moiré pitch $P_M$ and the vertical aperture pitch $P_y$ for various combinations of n and m are additionally illustrated. Numerical values scaled along the ordinate and the abscissa for representing $P_M$ and $P_y$ are standardized by the pitch $P_{NTSC}$ of scanning lines in NTSC system so as to exclude the variable relating to the size of CPT from the consideration. In order to make moirés imperceptible in both NTSC and PAL television system, it is necessary to select $P_y$ at the values corresponding to the bottoms of the curves. Additionally, for the combinations of n and m at which $P_M$ becomes relatively large when $P_y$ is selected at a certain value, it will be required to select the deviation $\Delta y$ such that the moiré may disappear as a whole. For setting in turn $\Delta y$ at a suitable value, it is required that the order of the magnitudes of $P_M$ shown in FIG. 30 may not be disturbed over a range of $P_y$ as wide as possible. The region of $P_y$ which fulfills the above conditions will correspond to the area enclosed by line segments 77 and 78 in FIG. 30 which can be mathematically expressed by $$1.43P_{NTSC} \leqq P_y \leqq 1.5P_{NTSC} \quad (43)$$

In this region, $P_M$ is increased in the order of curves 79, 80, 81, 82, 83 and 84. Although there are intersections among these curves in this region, the above order is not disturbed nor changed. Further, the conditions given by the formulae (39a) and (39b) are also satisfied. There are summarized in Table 6 the magnitudes of the moire pitch $P_M$ and the corresponding values of n in this region or area.

Table 6

| Increasing Order of $P_M$ | Number of Curves | Values of n |
|---|---|---|
| 1 | 79 | 2 |
| 2 | 80 | 1 |
| 3 | 81 | 2 |
| 4 | 82 | 1 |
| 5 | 83 | 2 |
| 6 | 84 | 1 |

As can be seen from the Table 6, the value of $\Delta y$ may be so selected that the moiré patterns will become imperceptible concurrently for the values 1 and 2 of n.

FIGS. 31 and 34 show examples of the most pertinent aperture pattern of the shadow mask used in common for both PAL and NTSC systems which are designed on the basis of moiré evaluation function which will at first be described before entering into the description of the shadow masks.

Referring to FIG. 39, it is assumed that the rectangles 17 represent the half-amplitude level of the moiré pattern waveform produced by the associated aperture row and the scanning lines. The vertical luminance pattern waveforms of moiré produced by the respective aperture rows $A_1, A_2, A_3, A_4 \ldots$ are represented by $C_1, C_2, C_3, C_4 \ldots$ The intensity of the moiré fringe produced in the oblique direction with angle $\theta$ relative to the horizontal is represented by the sum of the projections $C_i'$ of the individual moiré waves $C_i$ produced by the aperture rows and projected on the Z axis orthogonal to the oblique axis of the angle $\theta$. The phase of the moiré luminance pattern waveform of the i-th row having the origin P on the vertical coordinate axis is represented by $\phi_i$, while the phase of the waveform $C_i'$ having the origin P' on the Z axis is represented by $\phi_{\theta i}$. Then, the combined moiré waveform $\Omega(z,\theta)$ in the oblique direction of the angle $\theta$ is expressed as follows:

$$\Omega(z,\theta) = \sum_{i=1}^{k} C_i' = M_M \sum_{i=1}^{k} e^{-j\omega M\theta(z-\phi\theta i)} \quad (44)$$

wherein $$\omega_{M\theta} = 2\pi\mu_{M\theta} \quad (45)$$

$$\mu_{M\theta} = \frac{1}{P_{M\theta}} = \frac{1}{P_M \cos\theta} \quad (46)$$

The amplitude of the combined moiré waveform $\Omega(z,\theta)$ will depend on the phase $\phi_i$ or $\phi_{\theta i}$ in addition to the amplitudes $M_M$ of the individual moiré waves. The following relation exists between $\phi_i$ and $\phi_{\theta i}$.

$$\phi_{\theta i} = [(i-1)P_x \tan\theta - \phi_i] \cos\theta \quad (47)$$

Accordingly, when the pitch $P_{M\theta}$, amplitude and the angle $\theta$ of the combined moiré waveform $\Omega(z,\theta)$ are determined, the degree of the perceptibility of the moiré pattern in the direction of the angle $\theta$ may be approximately estimated from the spatial frequency characteristic of the visual system at the viewing distance 2H (H: vertical height of the picture) shown in FIG. 40 and the response characteristic curve of the visual system due to the anisotropy of the visual space as shown in FIG. 41. Assuming that $P_{M\theta}$ is dimensioned in mm, there is the following relation between the frequency f taken along the abscissa in FIG. 40 and $P_{M\theta}$:

$$f = 7.96/P_{M\theta}(\text{MHz}) \quad (48)$$

The frequency f represents the spatial frequency in terms of the frequency of video signal in a CPT of 2-inch type. The moiré evaluation function $W(\theta)$ weighed by the response of the visual system will then given by the following expression:

$$W(\theta) = (1/K)\Omega(z,\theta)R(f)E(\theta) \quad (49)$$

wherein

R(f): spatial frequency characteristic of the visual system, and $E(\theta)$: response of the visual system in the direction of the angle $\theta$.

Further, the index $I_M$ indicating the degree of perceptibility of the moiré as a whole pattern can be expressed as follows:

$$I_M = \frac{1}{180} \int_0^{180} W(\theta)\, d\theta \quad (50)$$

Now referring to FIG. 31, the aperture array pattern is composed of components:

$$\Delta y_1 = \tfrac{1}{2}P_y, \text{ and} \quad (51)$$

$$\Delta y_2 = \Delta y_3 = \tfrac{1}{3}P_y \quad (52)$$

When the deviation of $\Delta y$ in the upward direction is indicated by sign + with the downward deviation by sign −, the deviations are arrayed in the order of $\Delta y_1$, $\Delta y_2$, $\Delta y_3$, $-\Delta y_1$, $-\Delta y_2$ and $-\Delta y_3$. As can be seen from the formula (13B), if $$\Delta y_1 : n = 1, \text{ and}$$

$$\Delta y_2, \Delta y_3 : n = 1, n = 2$$

then the phase difference $\phi_M$ will fall within the range defined by the equation (13C). In other words, in the aperture array shown in FIG. 31, means for suppressing the moiré is provided by the ratio; (n=1):(n=2)=3:2. More specifically, in the region of $P_y$ shown in the Table 6, the moiré having the maximum pitch as indicated by the curve 84 in FIG. 30 is produced by the fundamental wave (m=1) of the field scanning line in PAL television system and the fundamental wave (n=1) of the aperture transmissivity pattern. With a view to suppressing such moiré pattern, the weight for n=1 is increased in respect to n=2. The moiré evaluation functions of such patterns for n(−1) and n(=2) are shown in FIGS. 32 and 33. As will be seen from FIG. 32, the combined amplitude of moiré for n(=1) is very small. In FIGS. 32 and 33, the magnitude of the combined moiré amplitude for $\theta=0°$ to 180° is standardized with $M_M$ equal 1.00. Further, in order to illustrate the effect of the pattern independently from $P_M$, the value of $P_M$ in the equation (46) is fixed at 10 mm. As is shown in FIG. 33, the amplitude of the oblique pattern for n(=2) is slightly greater than the pattern for n(=1), reflecting the weight imparted to n=2 when $\Delta y$ is determined. However, the moiré evaluation index $I_M$ defined by the equation (50) is 0.0698 which is the minimum value in the patterns of the above variety.

Figure 35:
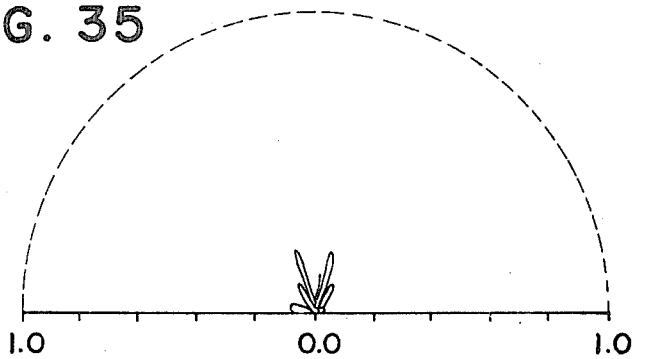
Figure 36:
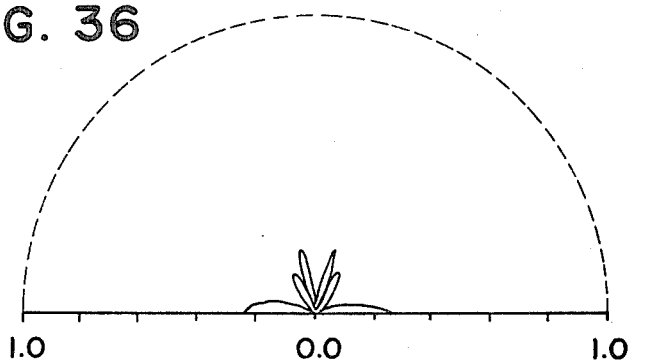
Figure 37:
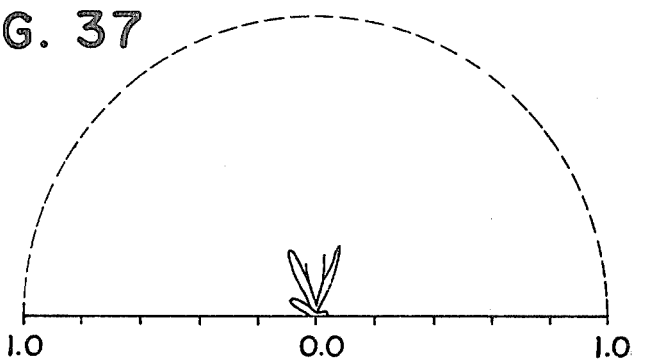
Figure 38:
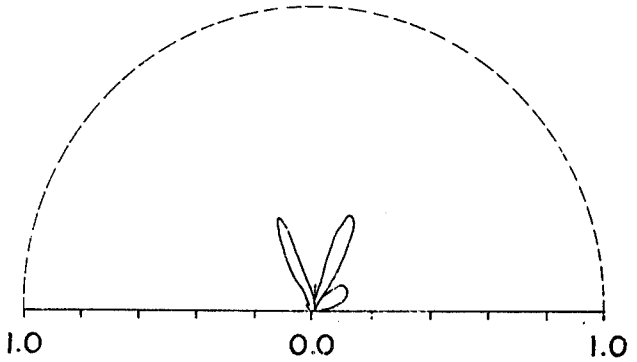

In another embodiment shown in FIG. 34, $$\Delta y_1=\tfrac{1}{2}P_y \quad (53)$$

$$\Delta y_2=\tfrac{1}{3}P_y \quad (54)$$

$$\Delta y_3=\tfrac{1}{4}P_y \quad (55)$$

and these deviations are arrayed in the order of $+\Delta y_1$, $+\Delta y_2$, $+\Delta y_3$, $-\Delta y_1$, $-\Delta y_2$ and $-\Delta y_3$. This pattern aims at suppressing moiré pattern which has the maximum moiré pitch for n(=2) in the region $P_y$ defined by the formula (43) in the frame scanning of PAL system, as is indicated by the curve 81. In the case of the first embodiment shown in FIG. 31, this pattern makes appearance as the oblique moiré pattern, as shown in FIG. 33. The embodiment shown in FIG. 34 is intended to suppress such oblique pattern. The moiré evaluation functions $W(\theta)$ for n(=1) and n(=2) remain substantially unchanged for n(=1) as compared with the embodiment shown in FIG. 31, while both the oblique and horizontal components are present when n=2, as shown in FIGS. 35 and 36. When the moiré pattern is dispersed in the horizontal and oblique direction in this manner, the unique pattern either in the horizontal or the oblique direction will disappear, which provides an advantage in practical use. The moiré evaluation index $I_M$ of this pattern is 0.113.

As will be understood from the foregoing description, the moiré suppressing effects through the selection of $P_M$ at a small value and the determination of $\phi_M$ at an optimum value are complementally combined in the case of the embodiments shown in FIGS. 31 and 34, as a result of which the moiré can be made imperceptible in NTSC and PAL systems.

What is claimed is:

1. A color picture tube having a shadow mask which is provided with a plurality of aperture rows juxtaposed to one another, said aperture row extending in perpendicular to a scanning line and comprising a plurality of electron beam transmissive apertures aligned with a predetermined pitch $P_y$, wherein there exists between positional deviation $\Delta y$ of said apertures relative to those in the adjacent aperture rows and said pitch $P_y$ the following relation:

$$\frac{(k-0.35)}{2n}Py \leqq \Delta y \leqq \frac{(k+0.35)}{2n}Py$$

in which n is a positive integer at least among 1, 2, 3 and 4, and k is a positive odd number smaller than 2n, and wherein said plurality of aperture rows include at last two different rows of different deviation $\Delta y$, wherein said shadow mask includes a combination of three varieties of aperture rows having different deviations $\Delta y_1$, $\Delta y_2$ and $\Delta y_3$ which are set in a range

| | |
|---|---|
| | $0.465\ P_y \leqq \Delta y_1 \leqq 0.535\ P_y$ |
| | $0.163\ P_y \leqq \Delta y_2 \leqq 0.338\ P_y$ |
| or | $0.663\ P_y \leqq \Delta y_2 \leqq 0.837\ P_y$ |
| | $0.081\ P_y \leqq \Delta y_3 \leqq 0.169\ P_y$ |
| or | $0.331\ P_y \leqq \Delta y_3 \leqq 0.418\ P_y$ |
| or | $0.581\ P_y \leqq \Delta y_3 \leqq 0.668\ P_y$ |
| or | $0.831\ P_y \leqq \Delta y_3 \leqq 0.918\ P_y$ |

2. A color picture tube having a shadow mask which is provided with a plurality of aperture rows juxtaposed to one another, said aperture row extending in perpendicular to a scanning line and comprising a plurality of electron beam transmissive apertures aligned with a predetermined pitch $P_y$, wherein there exists between positional deviation $\Delta y$ of said apertures relative to those in the adjacent aperture rows and said pitch $P_y$ the following relation:

$$\frac{(k-0.35)}{2n}Py \leqq \Delta y \leqq \frac{(k+0.35)}{2n}Py$$

in which n is a positive integer at least among 1, 2, 3 and 4, and k is a postive odd number smaller than 2n, and wherein said plurality of aperture rows include at least two different rows of different deviation $\Delta y$, wherein said pitch $P_y$ of said aperture rows lies in a range $$1.43P_{NTSC} \leqq P_y \leqq 1.50P_{NTSC}$$

wherein $P_{NTSC}$ represents a pitch of the scanning line of television signals in NTSC color television system.

3. A color picture tube according to claim 2, wherein six varieties of said aperture rows are sequentially arrayed in a predetermined period with the deviations $\Delta y$ of each of said aperture rows being $+\Delta y_1$, $+\Delta y_2$, $+\Delta y_3$, $-\Delta y_1$, $-\Delta y_2$ and $-\Delta y_3$, signs (±) indicating the directions of the deviation, and wherein $$\Delta y_1=\tfrac{1}{2}P_y$$

$$\Delta y_2=\Delta y_3=\tfrac{1}{3}P_y.$$

4. A color picture tube according to claim 2, wherein six varieties of said aperture rows are sequentially arrayed in a predetermined period with the deviations $\Delta y$ of each of said aperture rows being $+\Delta y_1$, $+\Delta y_2$, $+\Delta y_3$, $-\Delta y_1$, $-\Delta y_2$ and $-\Delta y_3$, signs (±) indicating the directions of the deviation, and wherein $\Delta y_1=\frac{1}{2}P_y$, $\Delta y_2=\frac{1}{3}P_y$, and $\Delta y_3=\frac{1}{4}P_y$.

5. A color picture tube according to claim 2, wherein the aperture rows having a specified deviation $\Delta y$ and the aperture rows having another different deviation $\Delta y$ are used in a large number.

* * * * *